United States Patent [19]

Liaw

[11] Patent Number: 4,585,364

[45] Date of Patent: Apr. 29, 1986

[54] BALL PEN COMBINED WITH ELECTRONIC WATCH

[76] Inventor: Dar-Kuei Liaw, P.O. Box 10160, Taipei, Taiwan

[21] Appl. No.: 424,296

[22] Filed: Sep. 27, 1982

[51] Int. Cl.[4] ..... B43K 29/00; B43K 29/08; G04B 37/00; G04B 37/12

[52] U.S. Cl. ..... 401/195; 368/278; 401/109; 401/110

[58] Field of Search ..... 401/195, 109, 110, 111; 368/278, 284

[56] References Cited

U.S. PATENT DOCUMENTS

| | | | |
|---|---|---|---|
| 3,343,292 | 9/1967 | Jorgensen | 401/195 |
| 3,544,227 | 12/1970 | Green | 401/195 X |
| 4,215,531 | 8/1980 | Wong | 368/278 X |
| 4,382,687 | 5/1983 | Lemelson | 368/284 X |

FOREIGN PATENT DOCUMENTS

| | | | |
|---|---|---|---|
| 0047379 | 3/1982 | European Pat. Off. | 401/195 |
| 1267144 | 11/1965 | Fed. Rep. of Germany | 401/195 |
| 1137022 | 5/1957 | France | 401/110 |
| 2333652 | 7/1977 | France | 401/195 |

*Primary Examiner*—Steven A. Bratlie

[57] ABSTRACT

A ball pen includes an electronic watch embedded in an inner jacket fixed within a pen cap, wherein the pen cap may be depressed to push ball point outwards for writing use and at the same time, electrically contact a circuit of the electronic watch for shifting the normal operation such as hour and minute indication to another operation such as month-and-date indication.

2 Claims, 9 Drawing Figures

BALL PEN COMBINED WITH ELECTRONIC WATCH

BACKGROUND OF THE INVENTION

Hon W. Wong disclosed watches in his U.S. Pat. No. 4,215,531 by enclosing a digital electronic watch housed within the same casing as a writing instrument.

Beneath the clip of his ball point pen there are arranged two contact terminals and when contact is made between a resilient tongue which is directly formed on the pen clip to serve as an actuating button for the electronic watch, and the first contact terminal, the watch is then energized. The tongue is equivalent to the button provided on wrist mounted watch for displaying the time. If another contact is made between second terminal and the clip, a resetting program may be initiated for another display use. Since the tongue is directly cut from pen clip and is formed outside a pen, it will be easily broken or damaged during handling, operation or clamping in pocket.

The present inventor has found the defects of conventional ball pen in combination of electronic watch and invented the present ball pen with watch.

SUMMARY OF THE INVENTION

The object of the present invention is to provide a push-button type ball pen combined with electronic watch wherein all push-button mechanism is provided within the pen cap and pen holder so that the ball point may be extended for writing by depressing the pen cap mounted on the upper portion of the pen and the electronic watch is also shifted to another operation when depressing the pen cap without damaging the push-button mechanism of the pen.

DETAILED DESCRIPTION

Figure 1:
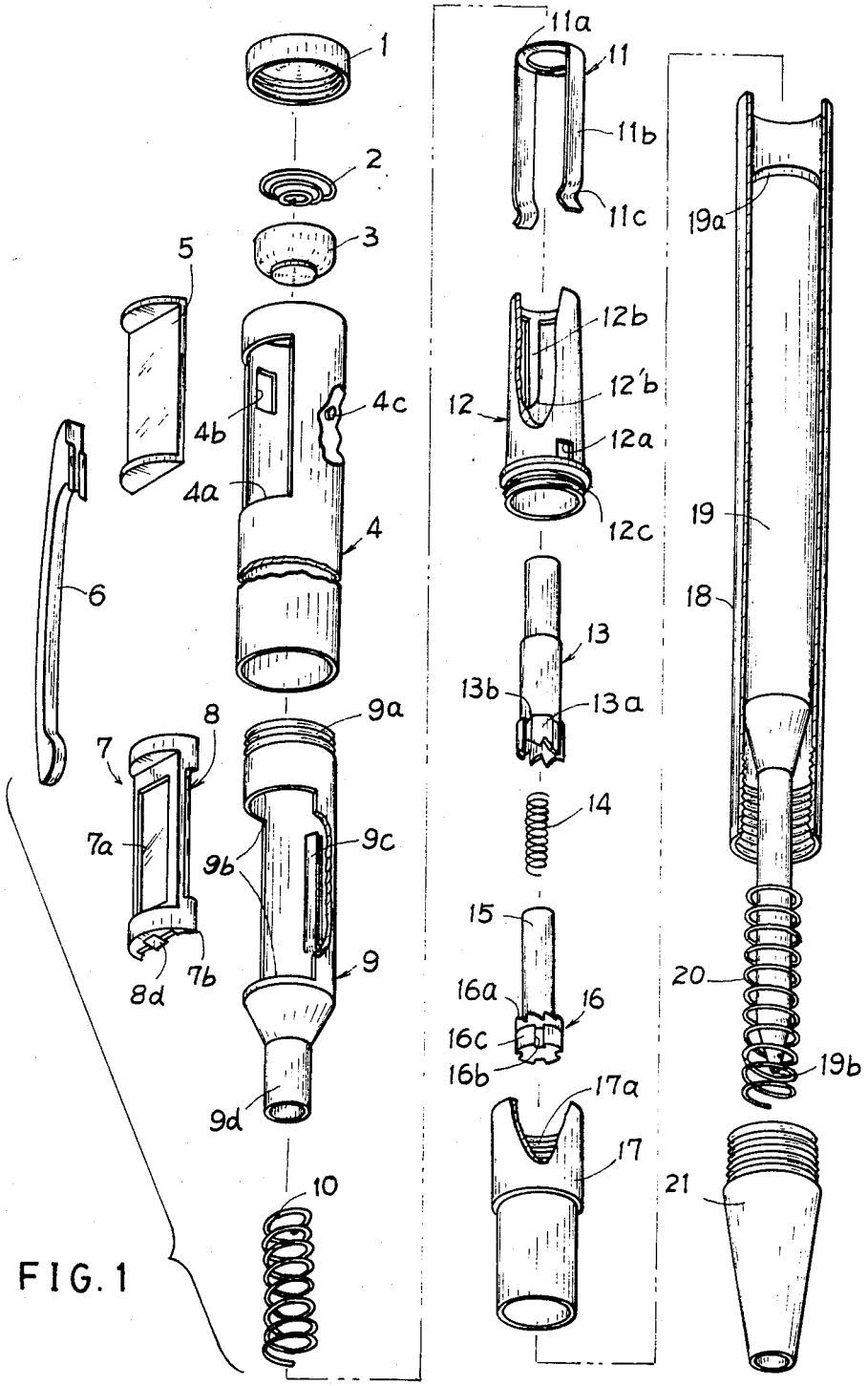
FIG. 1 is a perspective drawing showing all the separated parts of the present invention.
Figure 2:
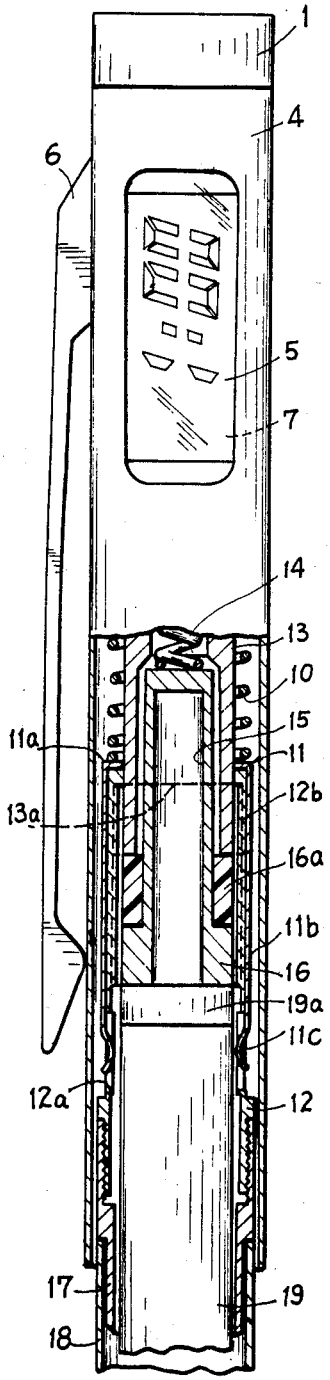
FIG. 2 is a partial sectional drawing of the present invention when retracting the ball point into the penholder.
Figure 3:
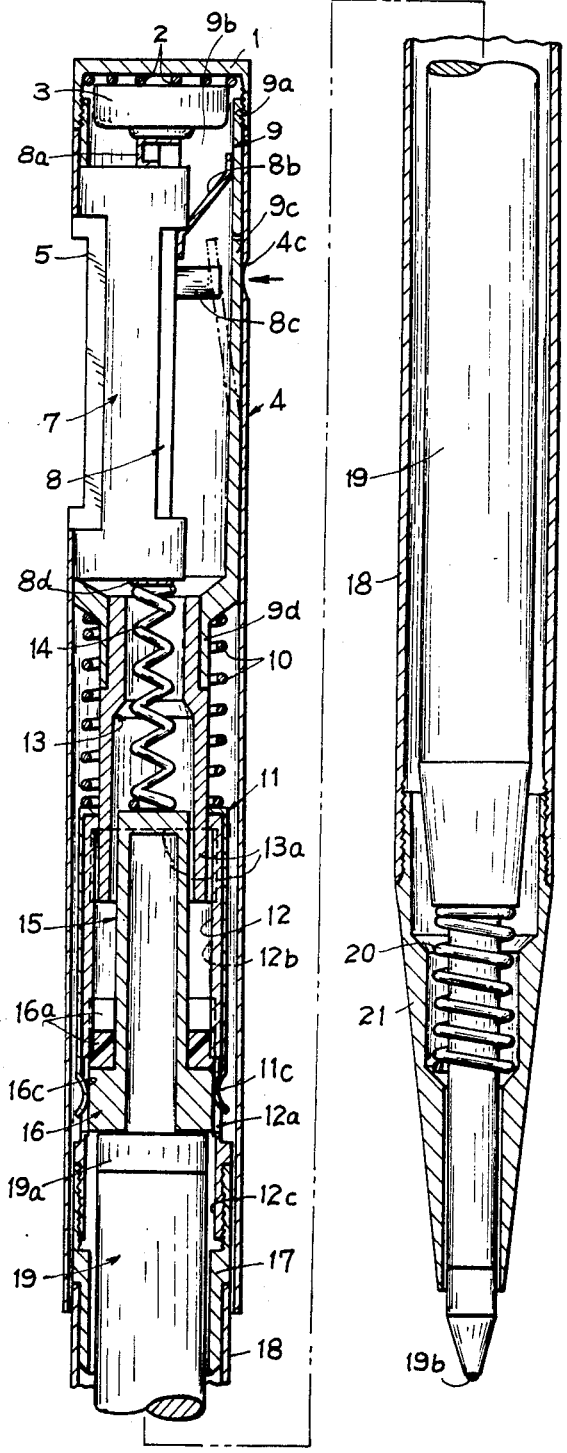
FIG. 3 is a sectional drawing of the present invention extending the ball point for writing use.

As shown in FIGS. 1, 2, 3, the present invention comprises: a hollow pen cap 4, an inner jacket 9 fixed within pen cap 4, an electronic watch 7 embeded in inner jacket 9, an outer spring 10 backing the lower portion of the inner jacket 9, a resilient conductor 11 positioned and tensioned under spring 10, a shifting stabilizer 12 clamped by resilient conductor 11, a connector 17 connected with the lower portion of shifting stabilizer 12, a lower penholder 18 fixed under connector 17, an innermost spring 14 positioned and tensioned under electronic watch 7, a contacting bolt 15 positioned under spring 14 and formed on its lower portion with a setting wheel 16 having a following gear 16*a*, a driving rod 13 which is inserted in the lower hollow portion of jacket 9 and formed with a driving gear 13*a* on its lower portion to reciprocatively move within stabilizer 12 and movably drive the following gear 16*a*, an inner refilled tube 19 positioned under wheel 16 and backed by a spring 20 restricted within the lower cap 21 connected under lower penholder 18, a power cell 3 fixed betwen electronic watch 7 and uppermost cover 1 as retained by a spiral spring 2.

Pen cap 4 is formed with a rectangular opening 4*a* which is fixed with a transparent cover 5 for display use. A small hole 4*c* is formed on cap 4 opposite to opening 4*a*. Another side hole 4*b* is formed on cap 4 for fixing pen clip 6.

Inner jacket 9 comprises an upper male-threaded portion 9*a* connected with the female-threaded portion of cover 1 atop cap 4, a central hollow portion 9*b* being inserted with electronic watch 7, a resilient plate 9*c* being formed by directly cutting an U-shaped slot on the jacket wall, and a lower contracted tube 9*d* which is inserted with driving rod 13.

Electronic watch 7 comprises a printed circuit board 8 fixed on a plastic base which is formed with a rectangular hole 7*a* coincided with opening 4*a* of cap 4 for display use, and formed with four wedges 7*b* to fix watch 7 into the hollow portion 9*b* of inner jacket 9. Wedges 7*b* are respectively formed with tapered surfaces 7*c* thereon for quickly fixing printed circuit board 8 into the grooves 7*d* formed on the plastic base of watch 7.

The printed circuit board 8 comprises four contactors of which the first contactor 8*a* is formed on the top end to connect one electrode of the power cell 3; the second contactor 8*b* is formed as a resilient plate and connected to the inside wall of jacket 9 to electrically contact pen cap 4, uppermost cover 1, spring 2 and another electrode of cell 3; the third contactor 8*c* extends from board 8 to an end slightly separated from resilient plate 9*c* of jacket 9 and is internally connected to a re-set pin of an integrated circuit of board 7; and a fourth contactor 8*d* positioned thereunder to contact spring 14.

Resilient conductor 11 comprises an upper annular ring 11*a* and two resilient conducting plates 11*b*, extending from ring 11*a*, each plate 11*b* being terminated with a hook 11*c* free contacting the bolt 15 through contacting surfaces 16*c* formed on wheel 16 under bolt 15.

Shifting stabilizer 12 is formed with two symmetric holes 12*a* on both sides thereof to allow hooks 11*c* poking through holes 12*a* to contact bolt 15 as FIG. 3 shown. Several lengthy extensions 12*b* are formed in parallel within stabilizer 12 of which each extension is terminated on its lower portion with a slope end 12'*b*. Stabilizer 12 is formed with a male-threaded portion 12*c* to connect the female-threaded portion 17*a* of connector 17. The top end of stabilizer 12 is defined by the upper ring 11*a* of conductor 11.

Figure 4:
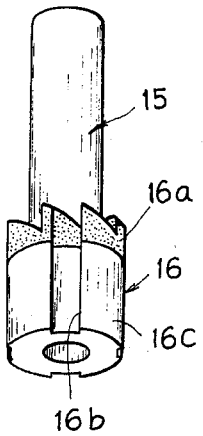
FIG. 4 is a perspective illustration of the contacting bolt and setting wheel in accordance with the present invention.
Figure 6:
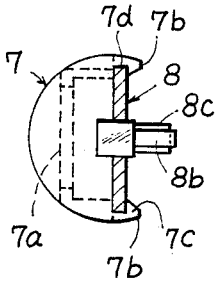
FIG. 6 is a top-view drawing of the electronic watch of the present invention.
Figure 5:
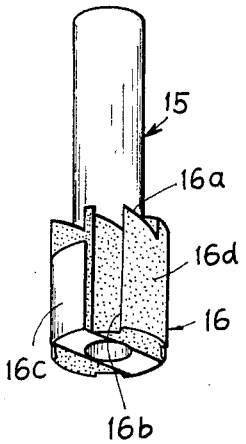
FIG. 5 shows another preferred embodiment derived from FIG. 4.
Figure 6A:
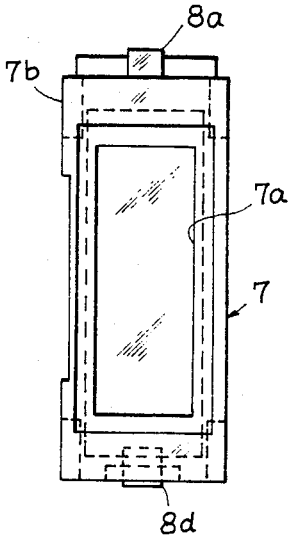
FIG. 6*a* is a front-view drawing of the electronic watch of the present invention.
Figure 6B:
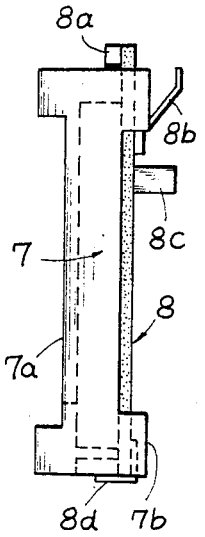
FIG. 6*b* is a side-view drawing of the electronic watch of the present invention.
Figure 7:
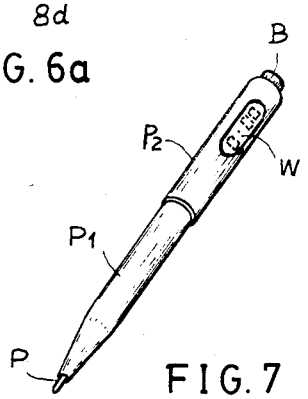
FIG. 7 shws a conventional ball pen combined with an electronic watch.

Driving rod 13 is formed with a driving gear 13*a* n its lower portion, which is cut with several lengthy grooves 13*b* to slidely engage with extensions 12*b* of stabilizer 12. Setting wheel 16 comprises an upper following gear 16*a* engaged with driving gear 13*a*, several lengthy grooves 16*b* formed on the wheel surface to slide along extension 12b, and several contacting surfaces 16c, disposed around the wheel surface and made from electrically conductive materials. For example, the contacting surfaces 16c may be made as four sectors as FIG. 4 shown or made as two sectors as FIG. 5 shown, wherein two opposite sectors 16c are made as electrically contacting surface and the other two opposite sectors 16d are made as electrically insulated. The bolt 15 and wheel surface 16c may be integratedly made during production.

The materials of spiral spring 2, uppermost cover 1, pen cap 4, inner jacket 9, outer spring 10, conductor 11, contacting bolt 15 and inner spring 14 should be made electrically conductive for the present invention. The upper portion 19a of inner refilled tube 19, driving rod 13 and stabilizer 12 should be made from insulated materials such as plastics.

Contactors 8a and 8b may be always closed to show the hour and minute of the electronic watch. Contactor 8c may be triggered by poking a needle-like tool through a small hole 4c, formed on cap 4 corresponding contactor 8c, to depress resilient plate 9c inwards and then depress the contactor 8c to temporarily stop the watch for digital time calibration. Contactor 8d may be energized to shift the hour and minute show of watch 7 into month and date indication. Resilient plate 9c serves as a dust proof for the present invention.

When using the present invention for writing, pen cap is depressed to lower driving rod 13 in which the driving gear 13a is sliding along the lengthy extensions 12b to force the following gear 16a outwards from the extensions 12b to be stably obstructed at the lowest end 12'b of lengthy extensions 12b to extend ball point 19b for writing use. At this time, the hooks 11c of resilient conductor 11 are poking through holes 12a to internally contact the surfaces 16c and bolt 15 so as to close a circuit through contactor 8a, power cell 3, spring 2, uppermost cover 1, cap 4, jacket 9, outer spring 10, conductor 11, bolt 15, inner spring 14 and the lower contactor 8d of printed circuit board 8 so that the electric watch will be shifted from hour and minute to month and date indication as FIG. 3 shown.

When re-depressing and then releasing the pen cap 4, the ball point 19b will be retracted into penholder 18 as conventional ball pen does and the setting wheel 16 wil also be retracted upwards to separate from conductor 11 as FIG. 2 shown so as to disconnect the power led to contactor 8d whereby the electronic watch 7 is operated normally.

By using the present invention, the ball pen combined with an electronic watch 7 may be fast and conveniently operated for writing and for shifting the operation of electronic watch merely by simple push-button action.

Of course, the electronic watch 7 can be modified as radio, music memory device, electronic calling device, etc., for wider applications.

The contacting bolt 15 with setting wheel 16 as shown in FIG. 4 is made to form four electric contacting sectors 16c so that every depression of the present invention may shift one electronic operation. If as FIG. 5 shown, the setting wheel 16 includes two opposite electric contacting sectors 16c and two other opposite insulated sectors 16d so that every two depressions of the present invention may only shift one electronic operation.

I claim:

1. A ball pen combined with electronic watch comprising:

a hollow pen cap, an inner jacket fixed within said pen cap, an electronic watch embedded in said inner jacket, an outer spring backing the lower portion of said inner jacket, a resilient conductor formed with two resilient conducting plates each terminated with a hook and tensioned under said outer spring, a shifting stabilizer clamped by said resilient conductor and formed with several lengthy extensions therein, and formed with two holes for said hooks of said resilient conductor extending therethrough, a connector connected with the lower portion of said shifting stabilizer, a lower penholder fixed under said connector, an innermost spring positioned and tensioned under said electronic watch, a contacting bolt positioned under said innermost spring and formed on its lower portion with a setting wheel having a following gear, said setting wheel having contacting surfaces a driving rod inserted in the lower hollow portion of said inner jacket and formed with a driving gear on its lower portion to reciprocatively move within said shifting stabilizer and movably drive said following gear, an inner refill tube positioned under said setting wheel and a power cell fixed between said electronic watch and an uppermost cover by a spiral spring inserted under said uppermost cover; the improvement which comprises: an electronic watch having a printed circuit board, which is formed with a first contactor on the top end of said watch to contact one electrode of said power cell; a second contactor formed as a resilient plate connected to said inner jacket to electrically contact said pen cap, said uppermost cover, said spiral spring and another electrode of power cell for normal time indication; a third contactor extending from said printed circuit board to an end slightly separated from a resilient plate formed on said inner jacket and being internally connected to a re-set pin of an integrated circuit of said printed circuit board; and a fourth contactor positioned under said electronic watch to electrically contact said innermost spring, whereby, when depressing said pen cap to lower said driving rod, said driving gear will force said following gear along the length extensions formed in said shifting stabilizer to be held at the lowest end of said lengthy extensions to extend said inner refill tube with ball point for writing use and at the same time, the hooks of said resilient conductor extending through the holes of said shifting stabilizer electrically contact the contacting surfaces of said setting wheel, said contacting bolt, said innermost spring and said fourth contactor of printed circuit board to close an electric circuit through said first contactor, said power cell, said spiral spring, said uppermost cover, said pen cap, said inner jacket, said outer spring, said resilient conductor so as to shift the normal operation of said electronic watch to another operation.

2. A ball pen combined with electronic watch according to claim 1, wherein said inner jacket is directly cut with an U-shaped slot thereon to form a resilient plate normally serving as a dust cover for said electronic watch inside said pen cap and inner jacket, said pen cap being formed with a small hole corresponding to said U-shaped resilient plate and corresponding to said third contactor of said electronic watch.

* * * * *